US005848601A

United States Patent [19]

Thies

[11] Patent Number: 5,848,601

[45] Date of Patent: Dec. 15, 1998

[54] DISHWASHER PUMP HAVING SOIL COLLECTION SYSTEM

[75] Inventor: Edward L. Thies, Niles, Mich.

[73] Assignee: Whirlpool Corporation, Benton Harbor, Mich.

[21] Appl. No.: 948,723

[22] Filed: Oct. 10, 1997

[51] Int. Cl.[6] ..... B08B 3/10

[52] U.S. Cl. ..... 134/104.4; 134/109; 134/111; 210/299

[58] Field of Search ..... 134/109, 111, 134/104.4; 210/409, 299

[56] References Cited

U.S. PATENT DOCUMENTS

| | | | |
|---|---|---|---|
| 2,862,510 | 12/1958 | Geiger et al. | 134/111 |
| 3,103,225 | 9/1963 | Schmitt-Matzen | 134/111 |
| 3,210,009 | 10/1965 | Long et al. | 134/111 |
| 3,370,598 | 2/1968 | Lopp et al. | 134/111 |
| 3,432,103 | 3/1969 | Hoppen | 239/255 |
| 3,502,090 | 3/1970 | Grunewald | 134/111 |
| 4,038,103 | 7/1977 | Grunewald | 134/10 |
| 4,243,431 | 1/1981 | Dingler et al. | 134/109 |
| 4,319,599 | 3/1982 | Dingler et al. | 134/104 |
| 4,392,891 | 7/1983 | Meyers | 134/10 |
| 4,559,959 | 12/1985 | Meyers | 134/109 |
| 4,673,441 | 6/1987 | Mayers | 134/18 |
| 5,165,433 | 11/1992 | Meyers | 134/104.4 |
| 5,377,707 | 1/1995 | Young, Jr. | 134/104 |

*Primary Examiner*—Frankie L. Stinson
*Attorney, Agent, or Firm*—Robert O. Rice; Thomas A. Schwyn; Joel M. Van Winkle

[57] ABSTRACT

A pump system for a dishwasher including a pump housing defining a pump chamber having an inverted frustroconical shape including an upwardly angled annular outer wall. An impeller is disposed within the pump chamber. An annular soil collection chamber is disposed partially above the pump chamber such that the bottom wall of the soil collection chamber forms the top wall of the pump chamber. Wash liquid is supplied into the soil collection chamber from the pump chamber through an opening provided in the bottom wall of the soil collection chamber located at the upper, peripheral portion of the pump chamber. The upwardly angled annular wall of the pump chamber promotes soil movement into the soil collection chamber by directing soils toward the upper portion of the pump chamber. The soil collection chamber is formed by an annular soil collector housing and a cover. The cover includes a plurality of filter screen panels such that wash liquid supplied into the soil collection chamber is filtered and soils are collected. By locating the collection chamber above the pump chamber, the inner diameter of the soil collection chamber may be formed smaller than the outer diameter of the pump chamber such that the outer diameter of the soil collection chamber may be minimized.

17 Claims, 3 Drawing Sheets

DISHWASHER PUMP HAVING SOIL COLLECTION SYSTEM

BACKGROUND OF THE INVENTION

1. Field of Invention

The present invention relates to a dishwasher pump and more particularly to a efficient and compact configuration for a dishwasher pump having a filtration and soil collection system.

2. Description of the Related Art

Typical domestic dishwashers in use today draw wash liquid from a sump at the bottom of a wash tub and spray the wash liquid within the wash tub to remove soils from dishes located on racks in the tub. In an attempt to improve performance and efficiency, some dishwashers employ a system for separating soil out of the recirculating wash liquid and for retaining the soils in a collection chamber. Frequently, a filter screen is used to retain soil in a soil collection chamber. U.S. Pat. No. 5,165,433, issued to Meyers, and U.S. Pat. No. 5,377,707, issued to Young, Jr., illustrate a common configuration for employing a filter screen in a dishwasher pump. In these references, the filter screen is arranged in an annular configuration in the cover of the dishwasher pump.

While filtering is an effective means for cleaning recirculating wash liquid, it is relatively costly to incorporate a filter screen into a dishwasher pump. Filter screens are typically formed from fine, synthetic mesh material, such as nylon or polyester, which is heat welded to a pump component, for forming a plurality of filter screen panels or segments. As the cost of the synthetic material is relatively high as compared to other dishwasher pump components, it is advantageous from a cost standpoint to minimize the amount of mesh used. However, in order to achieve satisfactory filter performance, the surface area of the filter screen must be sufficient to filter dishwasher wash liquid without undue clogging concerns.

In the annular filter screen configurations, as disclosed in the '433 and '707 references, the filter screen is fabricated out of rectangular sections of synthetic mesh which is then cut into the desired annular shape for incorporation in the dishwasher cover. During this fabrication process, the cut out center and corner sections are wasted. It can be readily appreciated, that for a predetermined filter screen surface area, the larger the inner diameter of the annular filter screen, the more waste material is generated in the cut out center portion and the corner portions. Accordingly, it is desirable, when designing a dishwasher pump employing an annular filter configuration, to minimize the inner diameter of the filter screen.

The '433 patent illustrates a pump which centrifugally separates wash liquid in a pump impeller cavity and supplies soil laden wash liquid to a soil container chamber. In centrifugal pump systems such as this one, it is desirable to provide a pump impeller cavity configured to aid in the centrifugal separation of soils and delivery to a soil container chamber.

Another problem to consider when designing dishwasher pump systems is water usage. Water usage is a critical concern in dishwasher operation for two reasons. Firstly, hot water usage is the principle factor in determining a dishwasher's energy performance. Secondly, conservation of water is becoming more and more of a concern in many regions of this country and the world. Accordingly, it is desirable to utilize a pump which is capable of effective operation with a minimal amount of water. In a vertical pump configuration such as shown in the patents '433 and '707, this means that it is preferable to have a pump having a minimal vertical height. In general, the shorter the pump, the less water is required for the pump to recirculate wash liquid in the dishwasher.

SUMMARY OF THE INVENTION

Accordingly, the present invention is directed to a pump system for a dishwasher including a pump housing defining a pump chamber having an inverted frustroconical shape including an upwardly angled annular outer wall. An impeller is disposed within the pump chamber. An annular soil collection chamber is disposed partially above the pump chamber such that the bottom wall of the soil collection chamber forms the top wall of the pump chamber. Wash liquid is supplied into the soil collection chamber from the pump chamber through an opening provided in the bottom wall of the soil collection chamber located at the upper, peripheral portion of the pump chamber. The upwardly angled annular wall of the pump chamber promotes soil movement into the soil collection chamber by directing soils toward the upper portion of the pump chamber. Soil is drained out of the soil collection chamber through a drain conduit having a flapper type check valve.

The soil collection chamber is formed by an annular soil collector housing and a cover which may be snap connected to the annular soil collector housing. The cover includes a plurality of filter screen panels such that wash liquid supplied into the soil collection chamber is filtered and soils are collected. By locating the collection chamber above the pump chamber, the inner diameter of the soil collection chamber may be formed smaller than the outer diameter of the pump chamber such that the outer diameter of the soil collection chamber may be minimized.

DESCRIPTION OF THE PREFERRED EMBODIMENT

Figure 1:
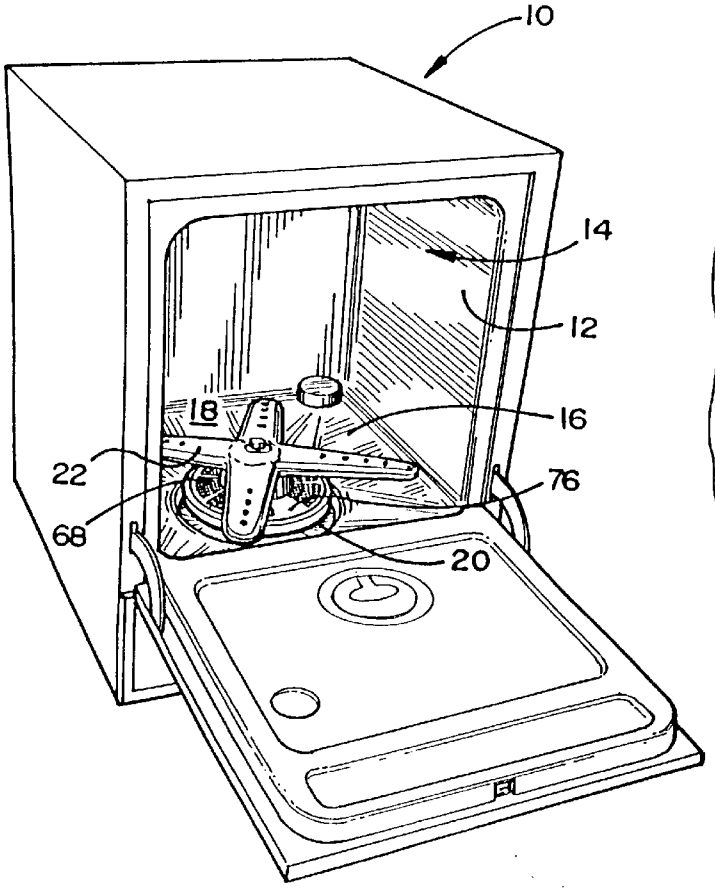
FIG. 1 is a perspective view of a dishwasher including a soil separation and collection system in accordance with the present invention.

In accordance with the invention as shown in the drawings, and particularly as shown in FIG. 1, an automatic dishwasher generally designated 10 includes an interior tub 12 forming an interior wash chamber or dishwashing space 14. The tub 12 includes a sloped bottom wall 16 which defines a lower tub region or sump 18 of the tub. A pump system 20, including a soil collection system, is centrally located in the bottom wall 16 and supplies wash liquid to a lower wash arm assembly 22 for recirculating wash liquid throughout the interior wash chamber. Wash liquid may also be supplied to an upper spray arm (not shown).

Figure 2:
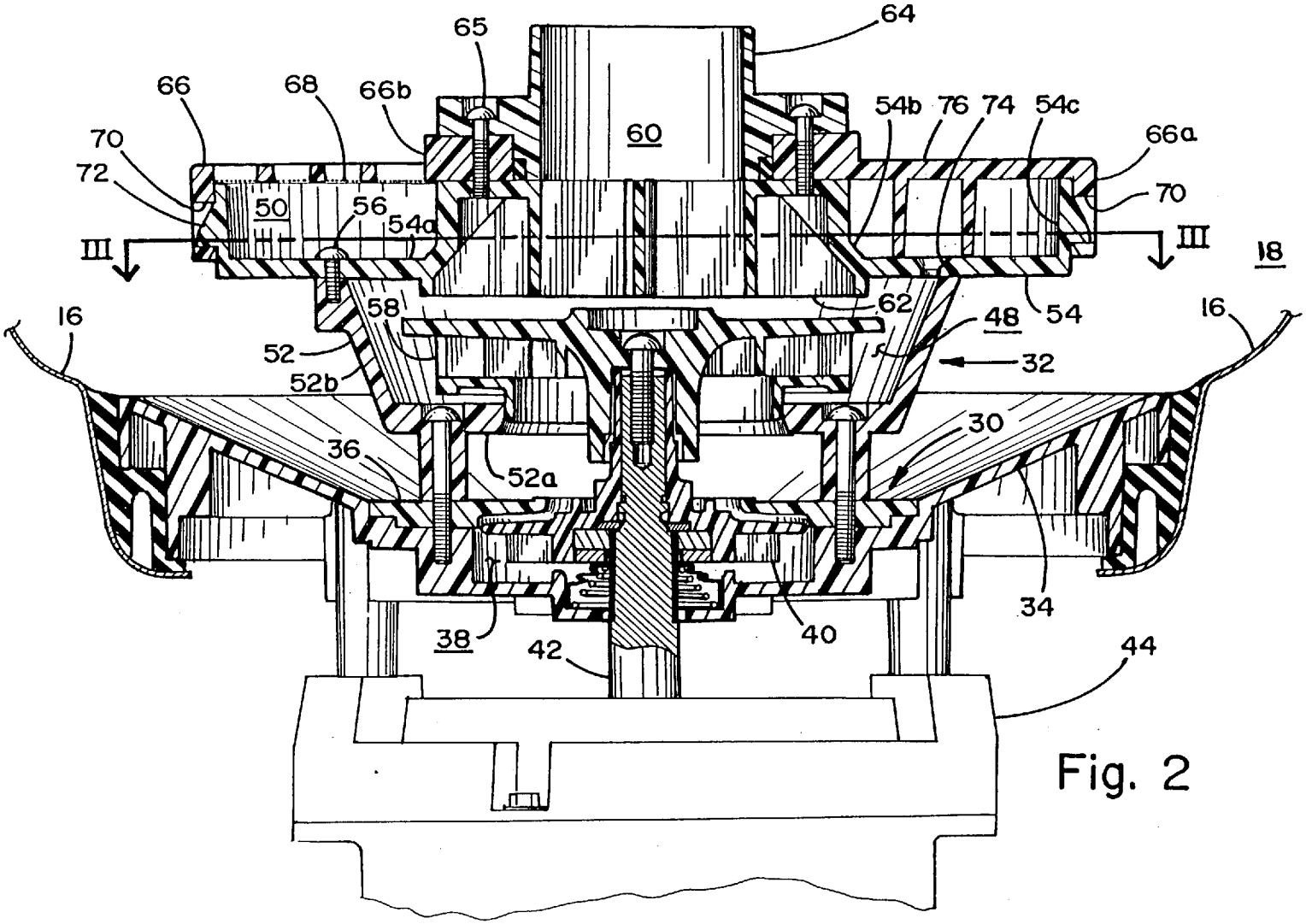
FIG. 2 is a diametric sectional view of a dishwasher pump as illustrated in FIG. 1.

Turning to FIG. 2, the pump system 20 is shown in greater detail. The pump includes lower and upper assemblies 30 and 32. The lower assembly 30 includes a pump base 34 and a drain cover 36 which define a drain impeller chamber 38. A drain impeller 40 is rotatably secured to an output shaft 42 of a motor 44 suspended below the pump system.

The upper assembly 32 of the pump system includes a pump chamber 48 and an annular soil collection chamber 50. A pump housing 52, which partially defines the pump chamber 48, is secured to the pump base 34 and includes a circular wall portion 52*a* and an upwardly angled, annular wall portion 52*b*. A soil collector housing 54 is disposed above and is fastened to the pump housing 52 via threaded fasteners 56 for forming the pump chamber 48. A wash impeller 58 is supported within the pump chamber 48 and is drivingly connected to the output shaft 42 of the motor 44.

Figure 3:
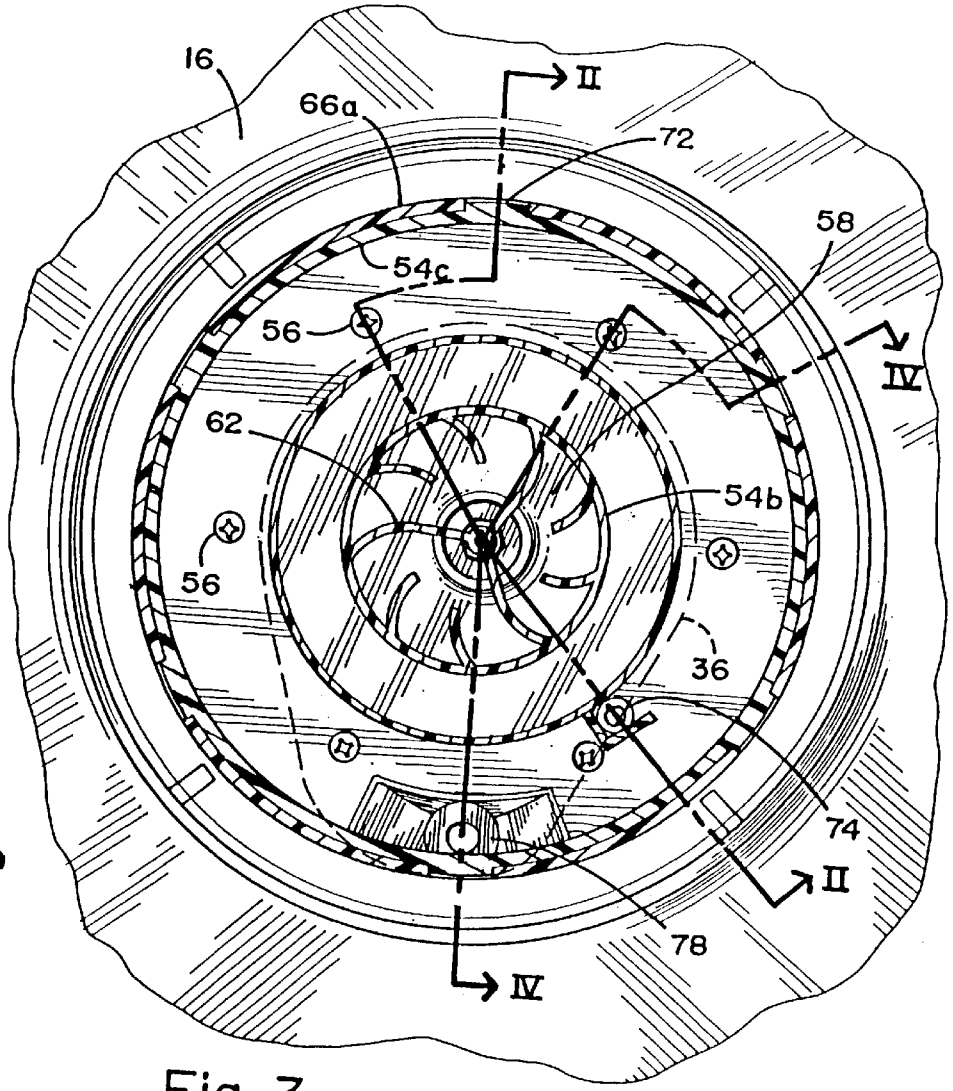
FIG. 3 is a sectional view, as taken along lines III—III of FIG. 2.

As shown in FIGS. 2 and 3, the soil collector housing 54 is formed having a flat annular wall 54*a*, an inner wall 54*b* upwardly angled from the inner peripheral edge of the flat annular wall 54*a* and an outer, cylindrical wall 54*c* extending upwardly from the outer peripheral edge of the annular bottom wall 54*a*. A center opening 60 is provided through the soil collector housing 54. A plurality of diffuser vanes 62 extend from the housing 54 toward the impeller 58 for generating pressure such that wash liquid is moved upwardly through the center opening 60. A pump outlet member 64 is connected to the center opening and directs wash liquid to the lower wash arm 22 and the upper wash arm of the dishwasher.

During a wash cycle, the wash impeller 58, driven by the motor 44, draws wash liquid from the sump 18 and pumps wash liquid up through a pump outlet member 64. The pump outlet member 64 may be secured to the soil collector housing 54 through use of fasteners 65. A first portion of wash liquid is sprayed from the lower wash arm 22 against dishes supported on a lower dishrack and a second portion of wash liquid may be directed toward an upper spray arm. Wash liquid is repeatedly recirculated over the dishes for removing soils therefrom.

Once soils are removed from the dishes, they are washed down into the sump 18. A chopping system may be provided for sizing soils prior to drawing them into the pump chamber 48. The basic constructional features of a chopper assembly are explained in U.S. Pat. No. 4,319,599, entitled "Vertical Soil Separator for Dishwasher", herein incorporated by reference. The use of a chopper is optional and is not necessary to practice the invention.

The soil collection chamber 50 is formed by connecting a cover 66 to the soil collector housing 54. The cover 66 is an annular member having a plurality of filter screen panels 68 (see FIG. 1). The filter screen panels 68 are formed from fine, synthetic mesh material, such as nylon or polyester, which is heat welded to the cover 66. The outer periphery of the cover 66 may preferably be snap connected to the soil collector housing 54 via snap openings 70 provided on an annular wall portion 66*a* of the cover 66 which engage projecting tabs 72 provided on the cylindrical wall 54*c*. A snap connection assembly may be used to connect the cover to the soil collector housing 54, rather than conventional use of threaded fasteners, due to the fact that the filter screen panels 68 prevent pressure built up such that the soil collection chamber is maintained at a relatively low pressure. The inner portion of the cover 66 is secured to the soil collector housing 54 by capturing an annular inner portion 66b of the cover 66 between the pump outlet 64 and the soil collector housing 54.

It can be seen, therefore, that the upper assembly 32 is configured such that the soil collection chamber 50 is disposed at an elevation above the pump chamber 48 and extends partially above the pump chamber 48. Specifically, as preferably disclosed, an inner annular portion of the soil collection chamber 54, comprising approximately half of the chamber 54, is disposed above the outer portion of the pump chamber 48, including an outermost annular portion of the wash impeller 58. This configuration, wherein the soil collection chamber is disposed partially above the pump chamber, allows for a soil collection chamber 54 having a relatively small outer diameter while maintaining a desirable filter screen area for filtering wash liquid.

As shown in FIG. 2, the soil collection chamber 50 receives soil laden wash liquid from the pump chamber 48 through opening 74 provided in the annular wall 54*a*. The opening 74 is located at the intersection of the upwardly angled wall 52*b* and the annular wall 54*a* at the outermost portion of the pump chamber. Soils in the pump chamber 48, due to the swirling action of the wash liquid, are urged to the outermost portion of the pump chamber by centrifugal forces such that the wash liquid supplied into the soil collection chamber is laden with soils removed from the dishes being washed. Moreover, the upwardly angled wall 52*b* further enhances the flow of soils into the soil collection chamber by directing the soils upwardly toward the opening 74. A deflector wall portion 76 is provided on the cover 66 opposite the opening 74 for deflecting the flow of wash liquid through the opening 74 about the soil collection chamber 50 such that soils do not become embedded into the filter screen panels.

Figure 4:
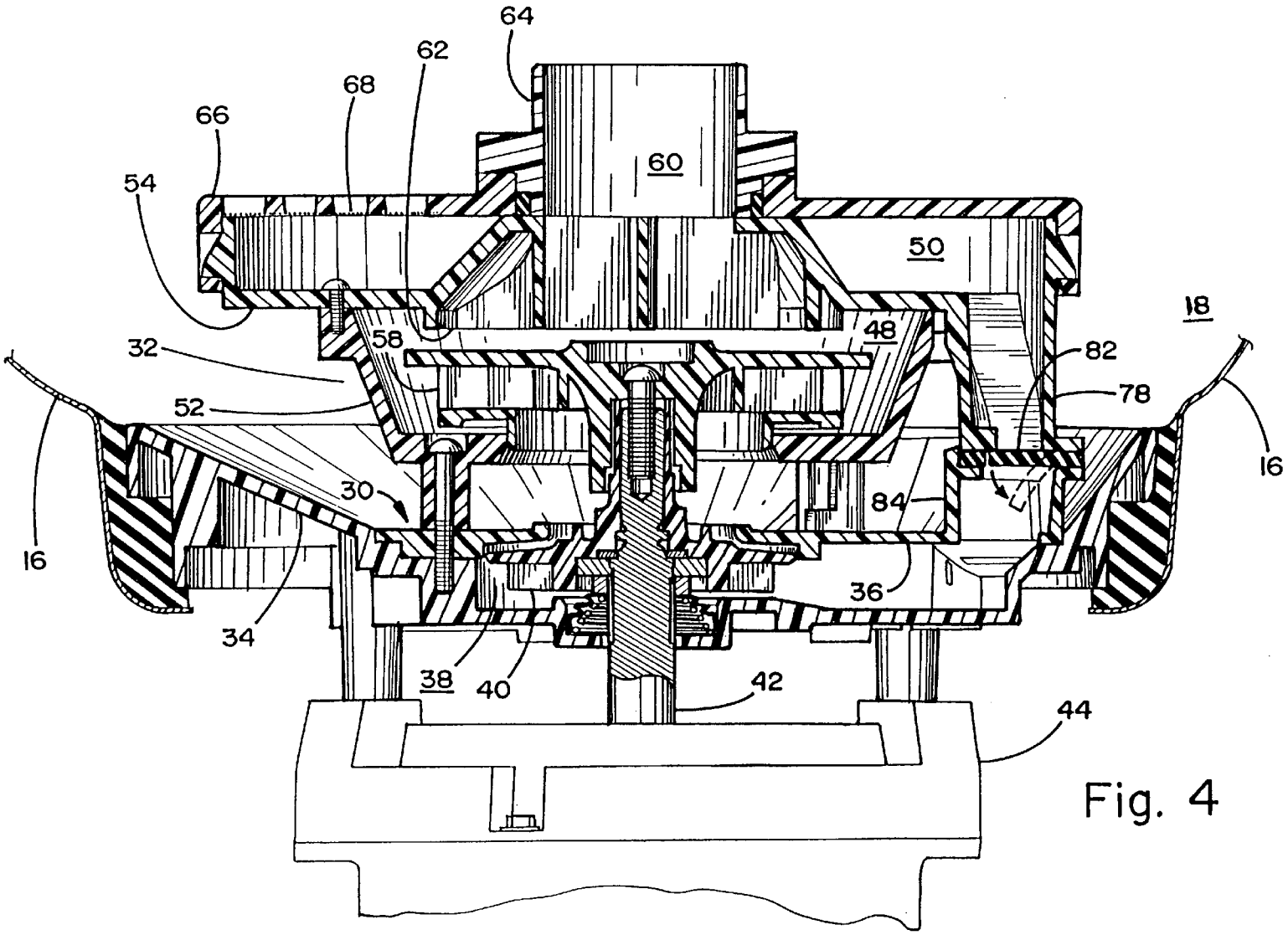
FIG. 4 is a diametric sectional view taken along line IV—IV of FIG. 3, illustrating the soil collector drain system.

FIG. 4 illustrates a diametric section of the pump system 20 cut through the drain system of the soil collection chamber 50. The drain system includes a drain conduit 78 extending between the soil collection chamber 50 and the drain impeller chamber 38. A flapper type valve 82 is captured between the bottom surface of the drain conduit 78 and a drain cover boss 84. The valve 82 operates as a check valve for the soil collector chamber such that during wash, the drain impeller urges the flapper valve 82 to close while during drain the flapper valve 82 opens such that soils can drain through the conduit 78 into the drain chamber 38. Accordingly, the drain cycle, the drain impeller 40 draws wash liquid out of the soil collection chamber 50 and pumps them to drain.

It can be seen, therefore, that the present invention provides for a uniquely compact and cost effective pump system including soil collection system. In particular, the pump is configured to minimize the outer diameter of the soil collection chamber, thereby minimizing the total amount of filter screen required during manufacture of the pump. Moreover, pump chamber 48 and the opening 74 for supplying wash liquid into the soil collection chamber 50 are configured to enhance soil separation and minimize assembly costs.

While the present invention has been described with reference the above described embodiment, those of skill in the Art will recognize that changes may be made thereto without departing from the scope of the invention as set forth in the appended claims.

I claim:

1. A pump system for a dishwasher, the dishwasher having an interior wash chamber receiving wash liquid and a sump disposed at the bottom of the wash chamber, the pump system comprising:

a wash arm disposed within the wash chamber;

a pump chamber having an outer diameter;

an centrifugal impeller disposed within the pump chamber for discharging wash liquid from the pump chamber to the wash arm and for forming a soil laden portion of wash liquid at the outer diameter of the pump chamber; and an annular soil collection chamber disposed partially above the pump chamber and having an inner diameter smaller than the outer diameter of the pump chamber, the annular soil collection chamber receiving wash liquid from the pump chamber.

2. The pump system according to claim 1, further comprising:

a pump housing defining the pump chamber having an inverted frustroconical shape wherein an outer periphery portion of the pump chamber is disposed below the annular soil collection chamber, the pump housing further having an opening provided at its upper outer edge through which soil laden wash liquid passes from the pump chamber into the annular soil collection chamber.

3. The pump system according to claim 1, further wherein the pump chamber comprises:

a circular bottom wall;

an annular top wall;

an upwardly angled annular wall having a bottom edge joining the periphery of the circular bottom wall and a top edge which intersects the annular top wall, the top edge having a greater diameter than the bottom edge, wherein the pump chamber is defined having an inverted frustroconical shape.

4. The pump system according to claim 3, further wherein the annular top wall forms the bottom surface of the annular collection chamber, the annular top wall having an opening through which soil laden wash liquid is delivered from the pump chamber into the soil collection chamber.

5. The pump system according to claim 1, further comprising:

a pump housing including:

a circular bottom wall, and an upwardly angled annular side wall; and a soil collector housing having an annular bottom surface and a cylindrical wall extending upwardly from the outer periphery of the annular bottom surface, the annular bottom surface engaging the top edge of the upwardly angled annular side wall, wherein the pump chamber is formed by the circular bottom wall, the upwardly angled annular side wall and the annular bottom surface such that the pump chamber has an inverted frustroconical shape.

6. The pump system according to claim 5, wherein the annular bottom surface of the soil collector housing has an opening disposed at the intersection of the annular bottom surface and the upwardly angled annular wall of the pump housing through which soil laden soil is supplied into the soil collection chamber from the pump chamber.

7. The pump system according to claim 5, further comprising:

a cover having a plurality of filter screen panels, the cover interconnecting with the soil collector housing for forming the soil collection chamber.

8. The pump system according to claim 5, further comprising:

a cover having an annular top surface having a plurality of filter screen panels and a cylindrical wall extending downwardly from the outer periphery of the annular top surface, wherein the cylindrical wall of the soil collector housing snap connects with the cylindrical wall of the cover and wherein the soil collection chamber is defined by the space between the cover and the soil collector housing such that the inner diameter of the soil collection chamber is smaller than the outer diameter of the pump chamber.

9. The pump system according to claim 1, further comprising:

a drain chamber disposed below the pump chamber;

a drain impeller disposed within the drain chamber for pumping fluid from the sump to drain;

a drain conduit extending from the annular soil collection chamber to the drain chamber; and a flapper type check valve disposed between the drain conduit and the drain chamber.

10. A pump system for supplying wash liquid to a wash arm within a dishwasher, the pump system comprising:

a pump chamber having a top wall;

an impeller disposed within the pump chamber for discharging wash liquid from the pump chamber to the wash arm and for forming a soil laden portion of wash liquid at the outer periphery of the pump chamber; and an annular soil collection chamber disposed partially above the pump chamber, the top wall of the pump chamber forming a bottom wall of the annular soil collection chamber, the annular soil collection chamber receiving wash liquid from the pump chamber.

11. The pump system according to claim 10, further wherein the top wall of the pump chamber has an opening through which soil laden wash liquid is supplied from the pump chamber into the soil collection chamber.

12. The pump system according to claim 10, further wherein:

the pump chamber includes an upwardly angled annular side wall having a top edge adjacent the top wall of the pump chamber, the upwardly angled annular side wall directing soils upwardly toward the opening in the top wall.

13. The pump system according to claim 10, further comprising:

a pump housing defining the pump chamber having an inverted frustroconical shape wherein an outer periphery portion of the pump chamber is disposed below the annular soil collection chamber, the pump housing further having an opening provided at its upper outer edge through which wash liquid passes from the pump chamber into the annular soil collection chamber.

14. The pump system according to claim 10, further comprising:

a pump housing having a bottom wall and an upwardly angled annular side wall; and a soil collector housing having an annular bottom surface and a cylindrical wall extending upwardly from the outer periphery of the annular bottom surface, the annular bottom surface engaging the top edge of the upwardly angled annular side wall.

15. The pump system according to claim 14, further comprising:

a cover for forming a top surface of the soil collection chamber, the cover having a plurality of filter screen panels.

16. The pump system according to claim 15, further wherein the cover comprises:

an annular top surface and a cylindrical wall extending downwardly from the outer periphery of the annular top surface, wherein the cylindrical wall of the soil collector housing snap connects with the cylindrical wall of the cover.

17. The pump system according to claim 10, further comprising:

a drain chamber disposed below the pump chamber;

a drain impeller disposed within the drain chamber for pumping fluid from the sump to drain;

a drain conduit extending from the annular soil collection chamber to the drain chamber; and a flapper type check valve disposed between the drain conduit and the drain chamber.

* * * * *